US010591856B2

(12) United States Patent
Sato et al.

(10) Patent No.: US 10,591,856 B2
(45) Date of Patent: Mar. 17, 2020

(54) ROLLER WITH FILLER BUNDLE IN ELASTIC LAYER AND FIXING DEVICE

(71) Applicant: CANON KABUSHIKI KAISHA, Tokyo (JP)

(72) Inventors: Yutaka Sato, Komae (JP); Kazuhiro Doda, Yokohama (JP); Kohei Wakatsu, Kawasaki (JP); Tsuguhiro Yoshida, Yokohama (JP); Jun Miura, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/371,295

(22) Filed: Apr. 1, 2019

(65) Prior Publication Data

US 2019/0324387 A1 Oct. 24, 2019

(30) Foreign Application Priority Data

Apr. 18, 2018 (JP) ..... 2018-079662
Feb. 21, 2019 (JP) ..... 2019-029887

(51) Int. Cl.
*G03G 15/20* (2006.01)

(52) U.S. Cl.
CPC ..... *G03G 15/206* (2013.01); *G03G 15/2053* (2013.01); *G03G 2215/2048* (2013.01)

(58) Field of Classification Search
CPC ..... G03G 15/206; G03G 15/2053
USPC ..... 399/333
See application file for complete search history.

(56) References Cited

U.S. PATENT DOCUMENTS

| | | | | |
|---|---|---|---|---|
| 8,005,413 | B2 | 8/2011 | Sakakibara et al. | |
| 8,224,223 | B2 | 7/2012 | Sakakibara et al. | |
| 8,369,763 | B2 | 2/2013 | Sakakibara et al. | |
| 8,401,450 | B2 | 3/2013 | Sekihara et al. | |
| 9,086,664 | B2 | 7/2015 | Matsunaka et al. | |
| 9,110,416 | B2 | 8/2015 | Uchiyama et al. | |
| 9,152,110 | B2 | 10/2015 | Miura et al. | |
| 9,268,273 | B2 | 2/2016 | Miyahara et al. | |
| 9,304,461 | B2 | 4/2016 | Miura et al. | |
| 9,335,690 | B2 * | 5/2016 | Asaka et al. | G03G 15/206 |
| 9,348,282 | B2 | 5/2016 | Tamura et al. | |
| 9,348,283 | B2 | 5/2016 | Takada et al. | |
| 9,367,009 | B2 | 6/2016 | Akiyama et al. | |
| 9,423,741 | B1 * | 8/2016 | Kimura | G03G 15/206 |
| 9,606,486 | B2 * | 3/2017 | Arai et al. | G03G 15/206 |
| 9,701,053 | B2 | 7/2017 | Asaka et al. | |
| 2019/0033762 | A1 | 1/2019 | Ikegami et al. | |

FOREIGN PATENT DOCUMENTS

| | | | |
|---|---|---|---|
| JP | 2003-190870 | A | 7/2003 |
| JP | 2004-290853 | A | 10/2004 |
| JP | 2009-31772 | A | 2/2009 |
| JP | 2009-103882 | A | 5/2009 |
| JP | 2009-109998 | A | 5/2009 |
| JP | 2011-085846 | A | 4/2011 |
| JP | 2016-024218 | A | 2/2016 |

* cited by examiner

*Primary Examiner* — William J Royer
(74) *Attorney, Agent, or Firm* — Venable LLP

(57) ABSTRACT

A roller for use with an image fixing device for fixing an image on a recording material includes a core metal, and an elastic layer provided around the core metal. In the elastic layer, a filler bundle including a plurality of fiber-like fillers is dispersed.

12 Claims, 11 Drawing Sheets

ROLLER WITH FILLER BUNDLE IN ELASTIC LAYER AND FIXING DEVICE

FIELD OF THE INVENTION AND RELATED ART

The present invention relates to a roller for use with a fixing device mountable in an image forming apparatus such as an electrophotographic copying machine or an electrophotographic printer, and relates to a fixing device including a binder.

As the fixing device mounted in the copying machine or printer of an electrophotographic type, a fixing device of a film heating type has been known. The fixing device of this type includes a rotatable cylindrical film, a plate-like heater for heating the film while contacting an inner peripheral surface of the film, and a pressing roller for forming a nip in cooperation with the heater through the film. A recording material on which an unfixed toner image is carried is heated while being nipped and fed through the nip, whereby the toner image is fixed on the recording material.

In a copying machine or a printer, it has been known that when images are continuously printed on small size recording materials in the same print intervals as those of large size recording materials, non-passing regions, of a nip of the fixing device, where the small size recording materials do not pass excessively increase in temperature. When the non-passing regions of the nip of the fixing device excessively increase in temperature, the film heated by the heater and a holder supporting the heater are damaged.

In order to suppress overheating of the non-passing regions of the nip, a constitution in which heat in the non-passing regions of the nip is transferred to a passing region by enhancing thermal conductivity of a pressing roller with respect to a direction perpendicular to a recording material feeding direction and thus a temperature of the non-passing regions is lowered has been proposed. Japanese Laid-Open Patent Application (JP-A) 2009-31772 discloses a pressing roller prepared by providing, on an outer peripheral surface of a solid rubber elastic layer, an elastic layer containing thermally conductive fillers such as pitch-based carbon fibers. JP-A 2009-103882 discloses a pressing roller in which thermally conductive fillers are contained in an adhesive layer between an elastic layer and a parting layer.

With speed-up of a processing speed (process speed) of the printer, there is a tendency that the increased temperature of the non-passing regions of the nip of the fixing device becomes high, so that further suppression of the overheating of the non-passing regions has been required. This is because a time in which the recording material passes through the nip becomes short with the speed-up and thus a fixing temperature required for heat-fixing a toner image on the recording material has to be made high. Further, a time in which the recording material does not exist in the nip during continuous printing (hereinafter, this time is referred to as a recording material interval) is decreased with the speed-up of the printer, and therefore, it becomes difficult that temperature distribution non-uniformity is uniformized during the recording material interval.

Therefore, in order to further suppress the overheating of the non-passing regions of the nip, constituting in which the thermal conductivity of the pressing roller is enhanced with respect to the direction perpendicular to the recording material feeding direction would be considered. As one of the constitutions, a constitution in which a fiber length of thermally conductive fillers such as carbon fibers is made long would be considered.

However, when the fiber length of the fillers is made long, the fibers are entangled with each other or the like, so that a reinforcing effect generates, and thus a hardness of the pressing roller remarkably increased in some cases. As a result, there was a problem that a width of the nip with respect to the recording material feeding direction decreased and thus a fixing performance lowered.

SUMMARY OF THE INVENTION

A principal object of the present invention is to provide a roller capable of suppressing an increase in hardness even when fiber-like thermally conductive fillers are used.

Another object of the present invention is to provide a fixing device including the roller.

According to an aspect of the present invention, there is provided a roller for use with an image fixing device for fixing an image on a recording material, the roller comprising: a core metal; and an elastic layer provided around the core metal, wherein in the elastic layer, a filler bundle including a plurality of fiber-like fillers is dispersed.

Further features of the present invention will become apparent from the following description of exemplary embodiments with reference to the attached drawings.

Figure 3:
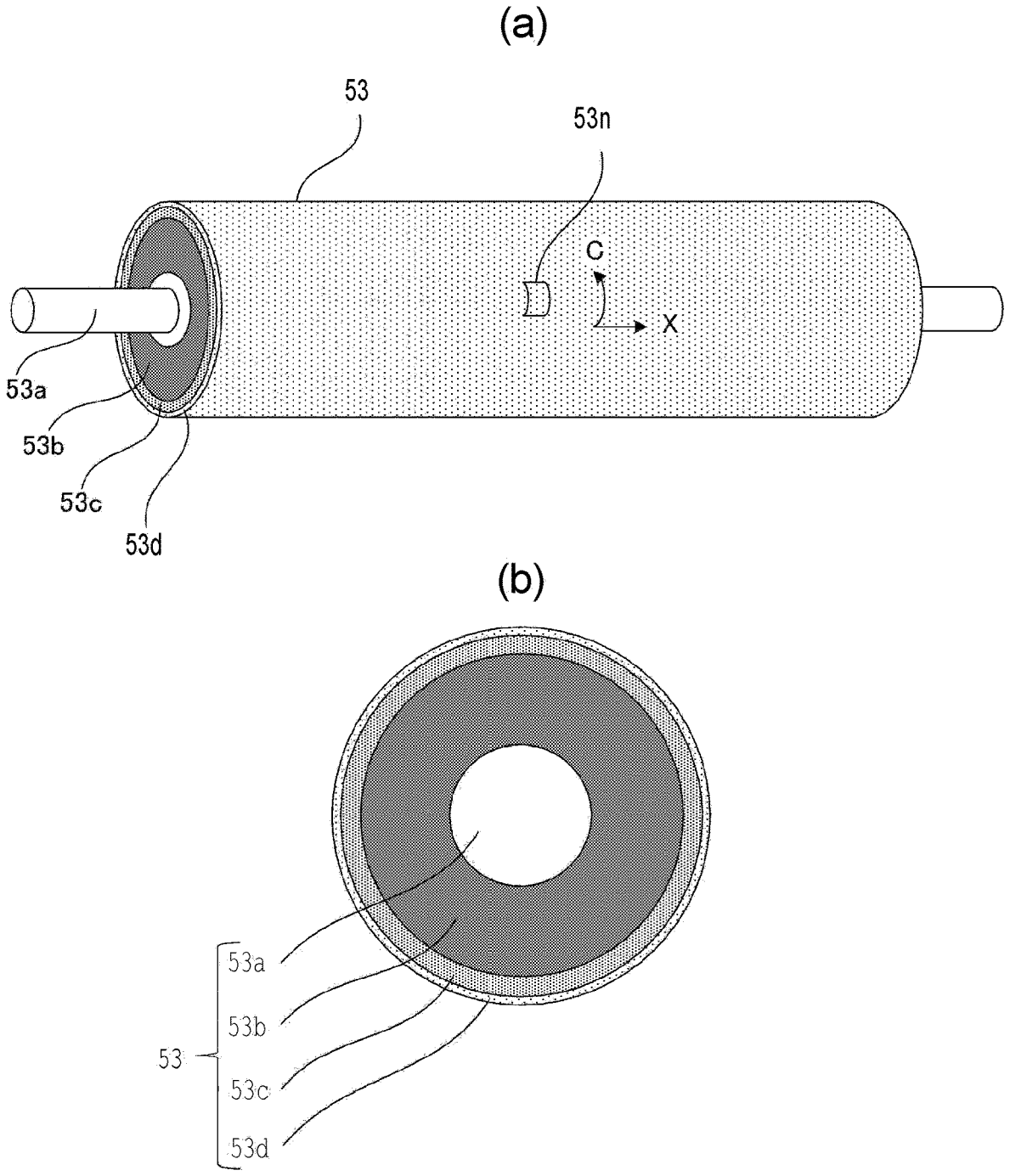

Parts (a) and (b) of FIG. 3 are a perspective view and a sectional view, respectively, of a pressing roller.

Figure 4:
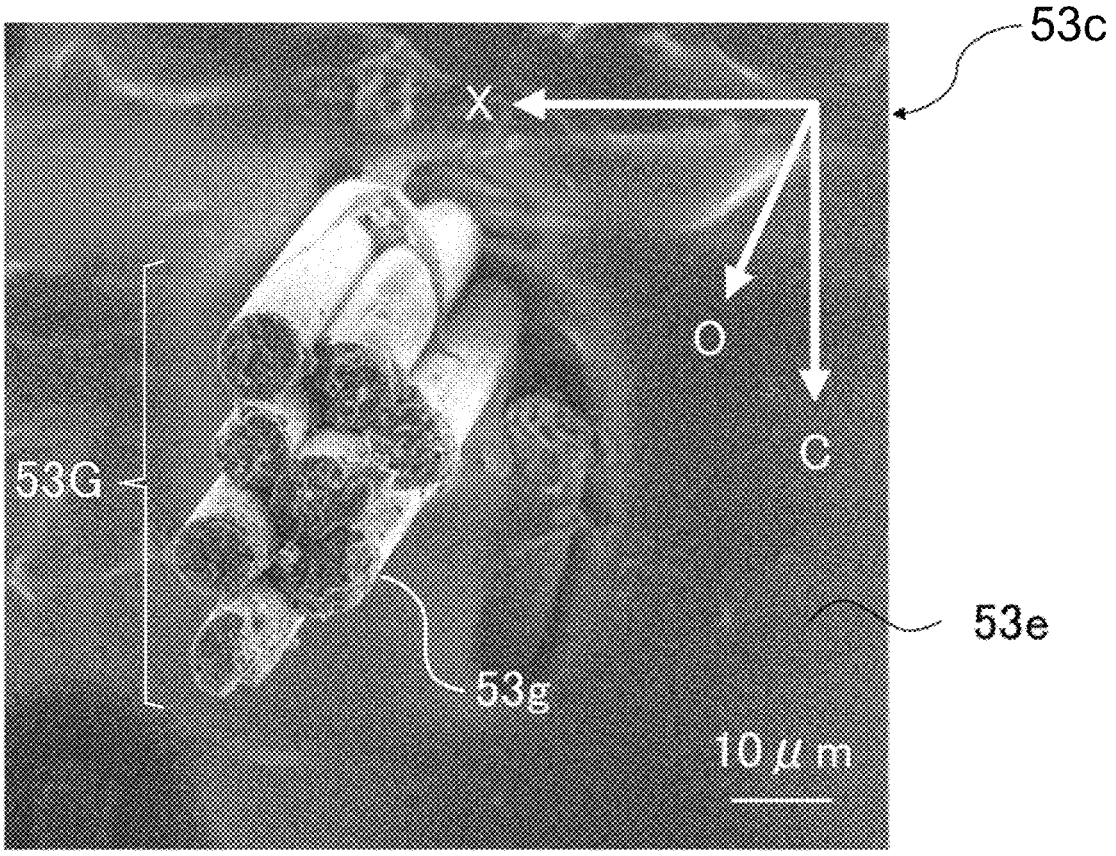

FIG. 4 is a photograph showing a cut portion of a thermally conductive layer of the pressing roller.

Figure 5:
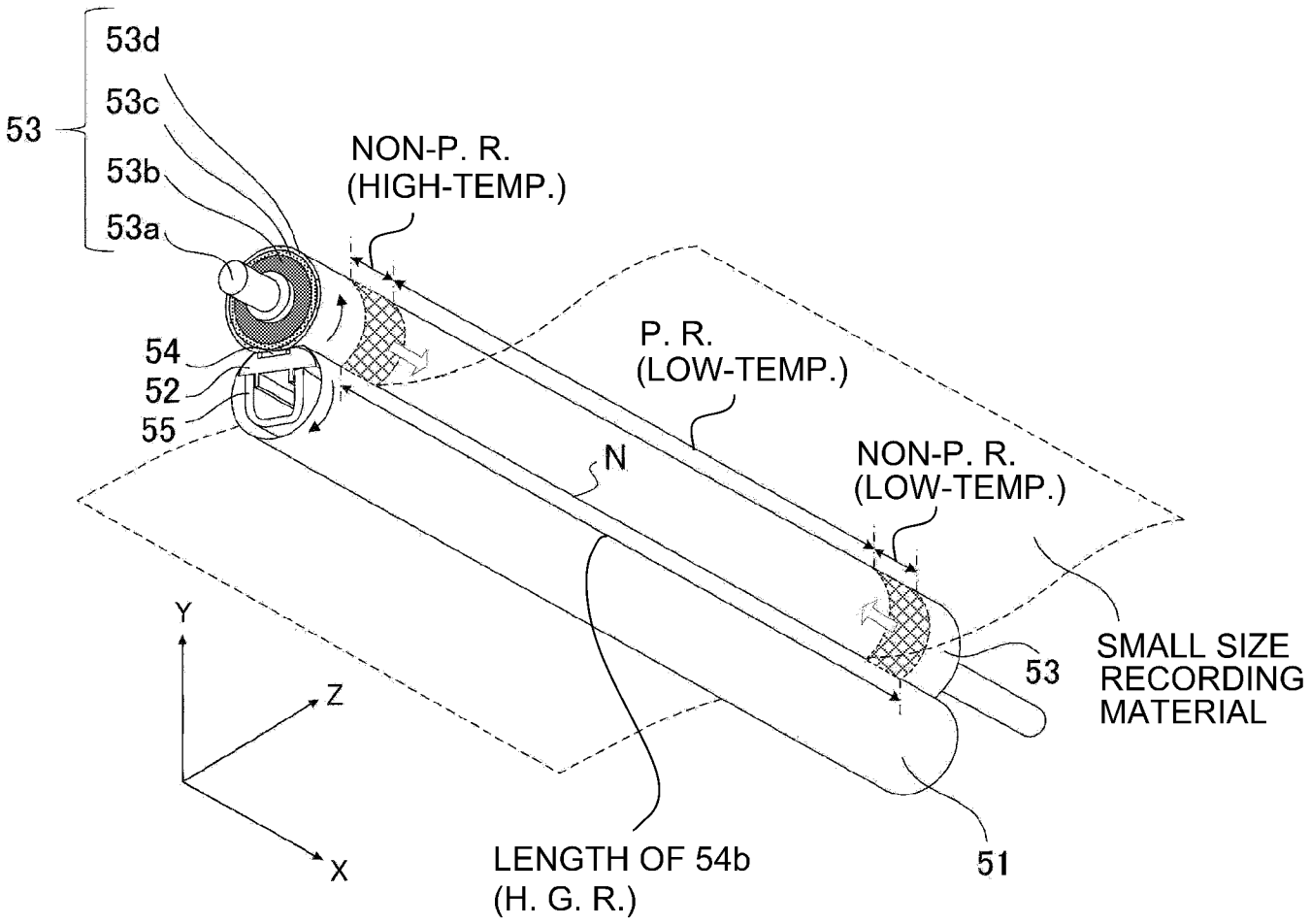

FIG. 5 is a perspective view of the fixing device showing a state in which a small size recording material is fed through a nip.

Figure 6:
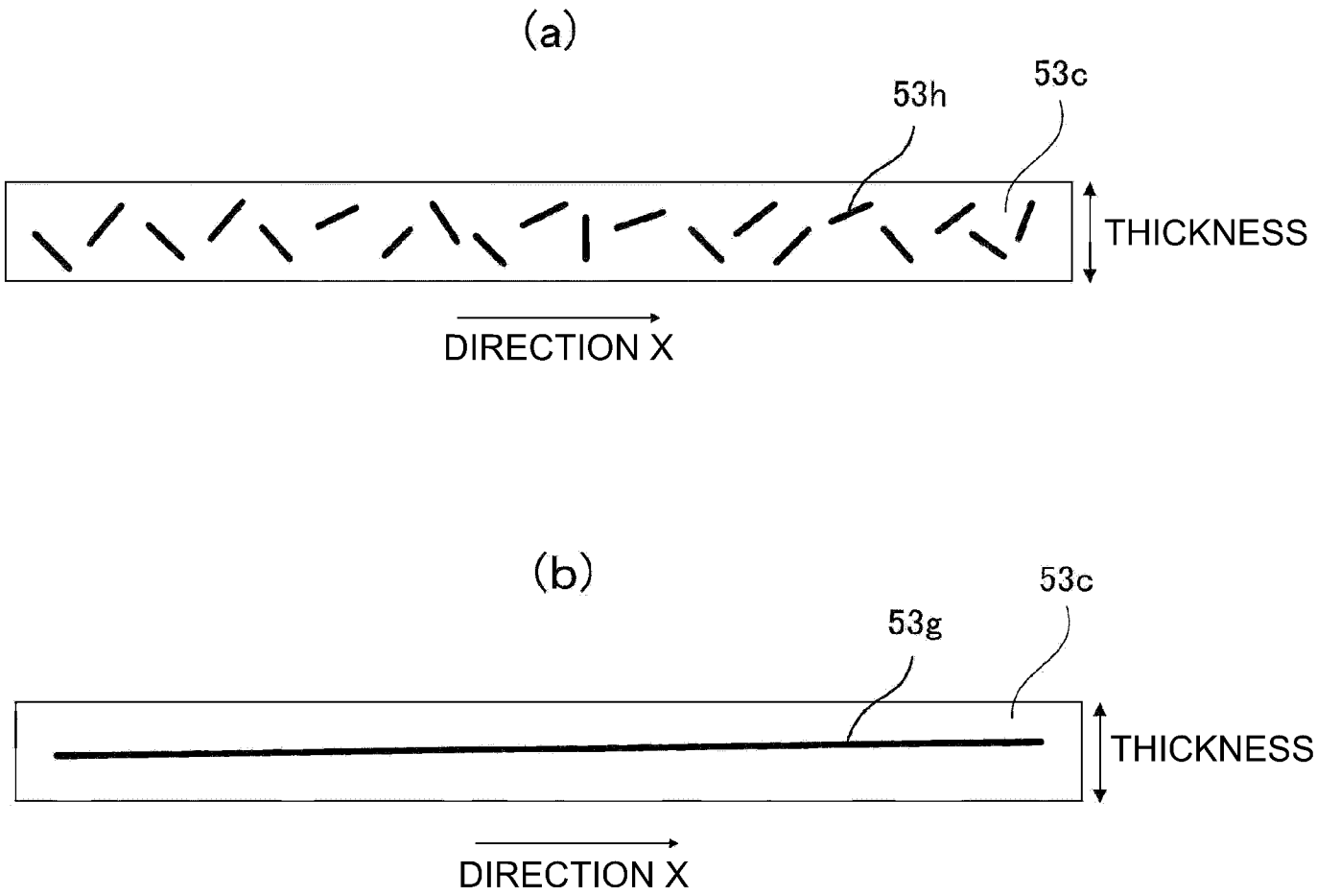

Parts (a) and (b) of FIG. 6 are sectional views of thermally conductive layers, in which part (a) shows the thermally conductive layer containing short fillers, and part (b) shows the thermally conductive layer containing a long filler.

Figure 7:
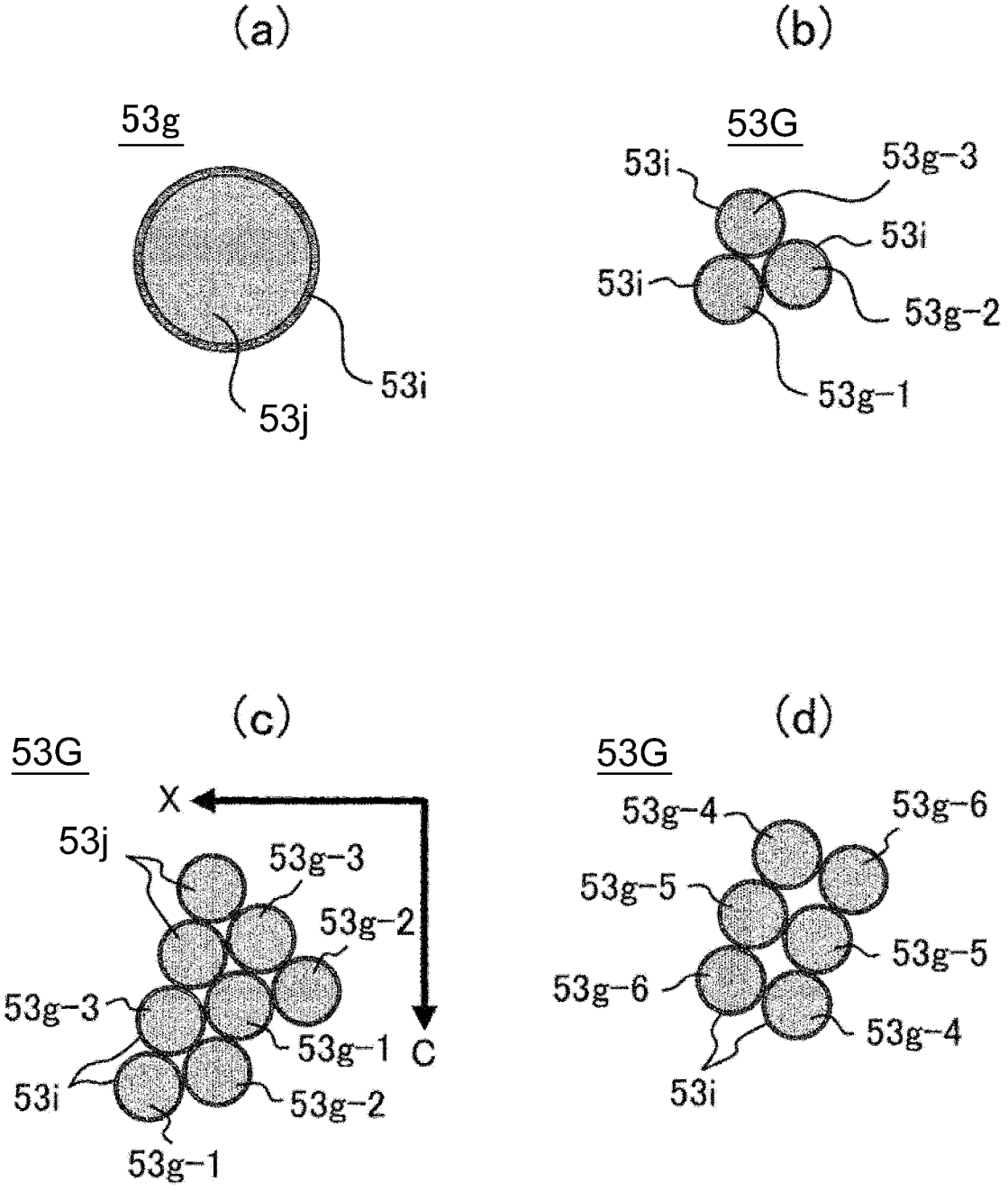

Parts (a) to (d) of FIG. 7 are sectional views of fillers, in which part (a) shows a single filler, part (b) shows three fillers collected in a bundle shape, part (c) shows eight fillers collected in a bundle shape, and part (d) shows six fillers collected in a bundle shape.

Figure 8:
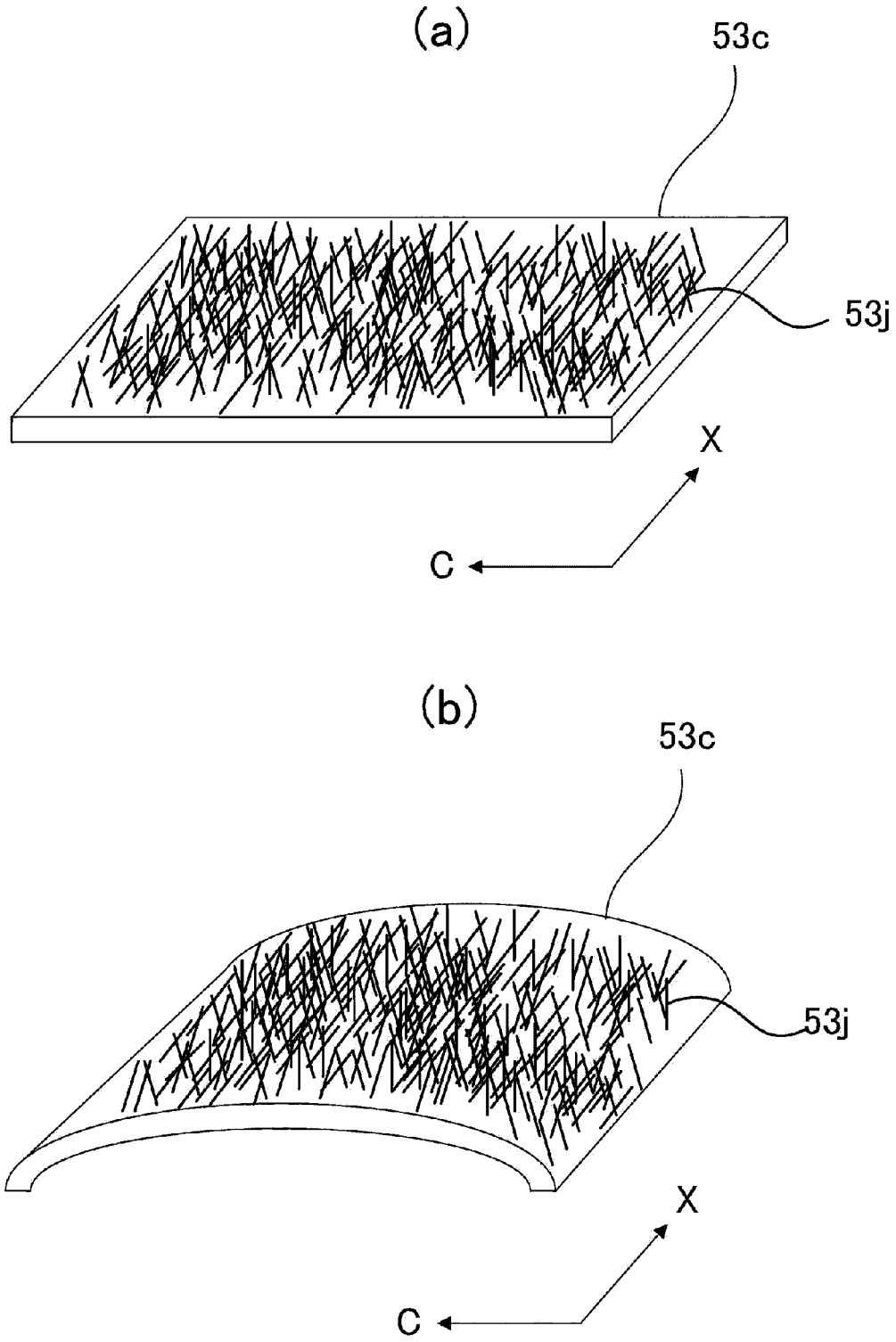

Parts (a) and (b) of FIG. 8 are schematic views showing fillers which are dispersed in the thermally conductive layer and which are not collected in a bundle shape, in which part (a) shows a flat state of the thermally conductive layer, and part (b) shows a flexed (curved) state of the thermally conductive layer.

Figure 9:
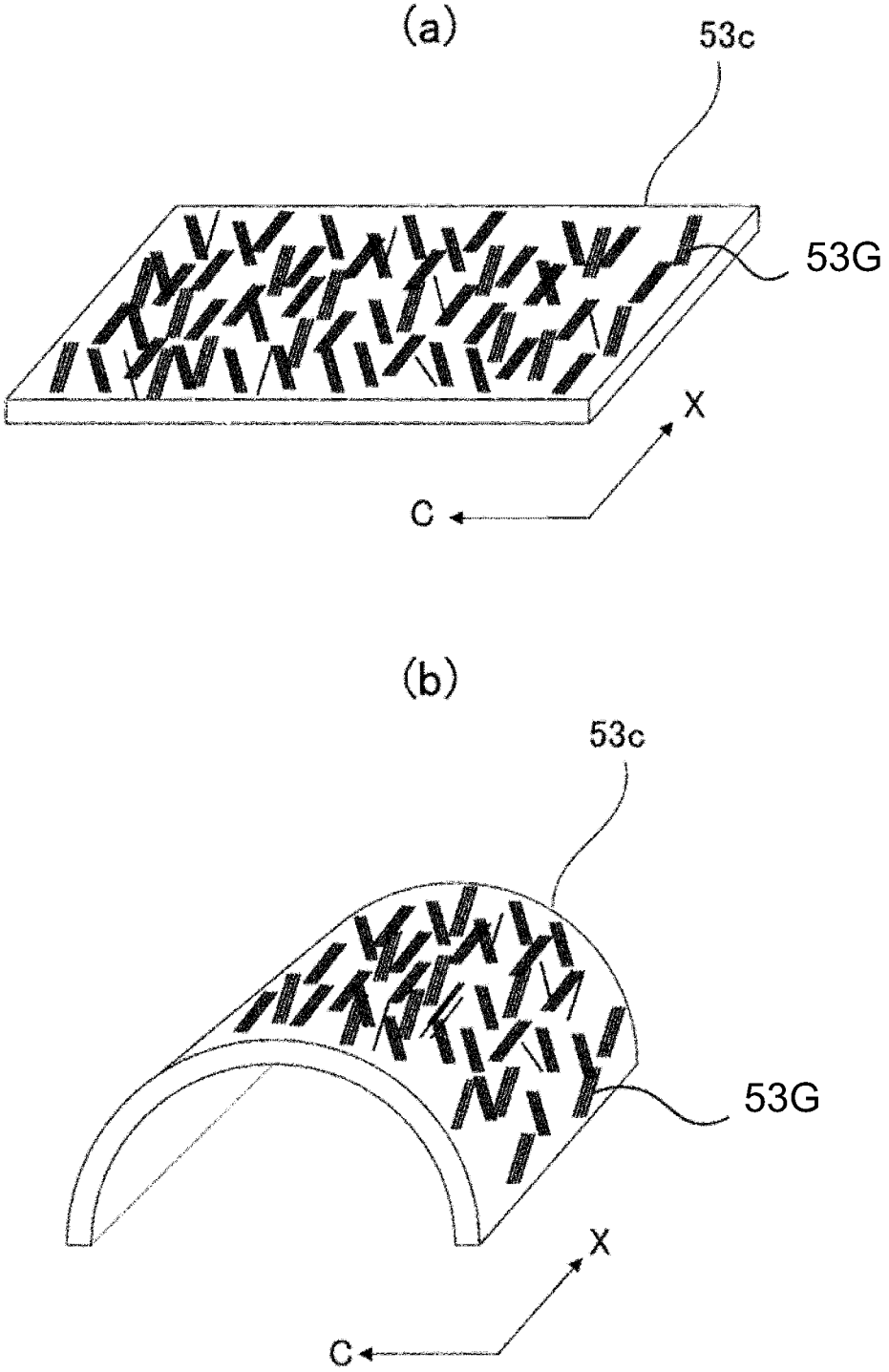

Parts (a) and (b) of FIG. 9 are schematic views showing fillers which are dispersed in the thermally conductive layer and which are collected in a bundle shape, in which part (a) shows a flat state of the thermally conductive layer, and part (b) shows a flexed state of the thermally conductive layer.

Figure 10:
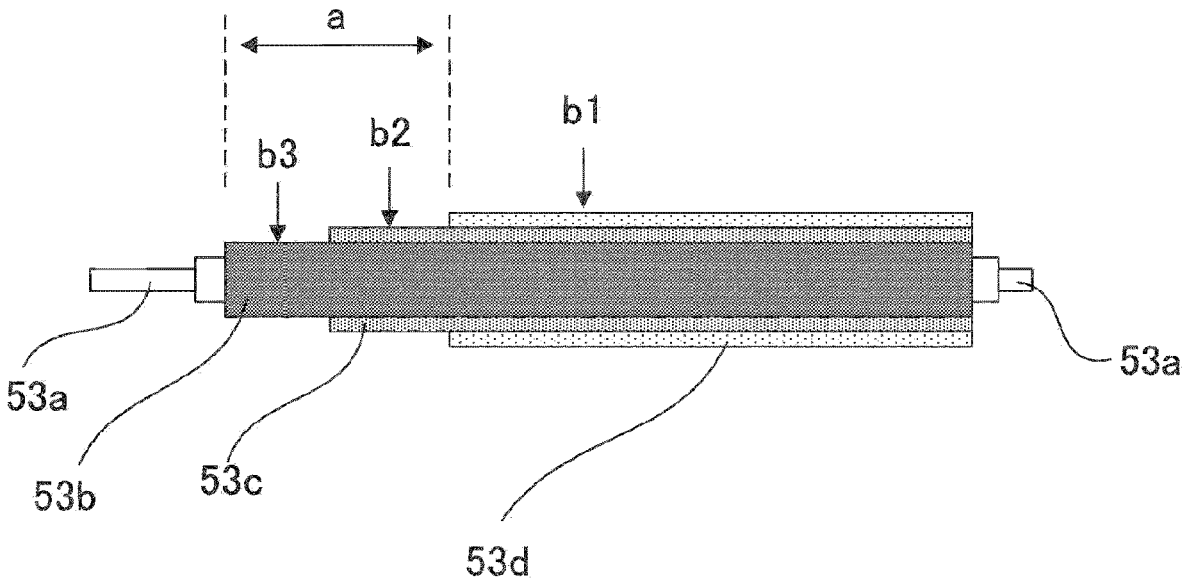

FIG. 10 is a schematic view showing hardness measuring points of the pressing roller with respect to a direction perpendicular to the recording material feeding direction.

Figure 11:
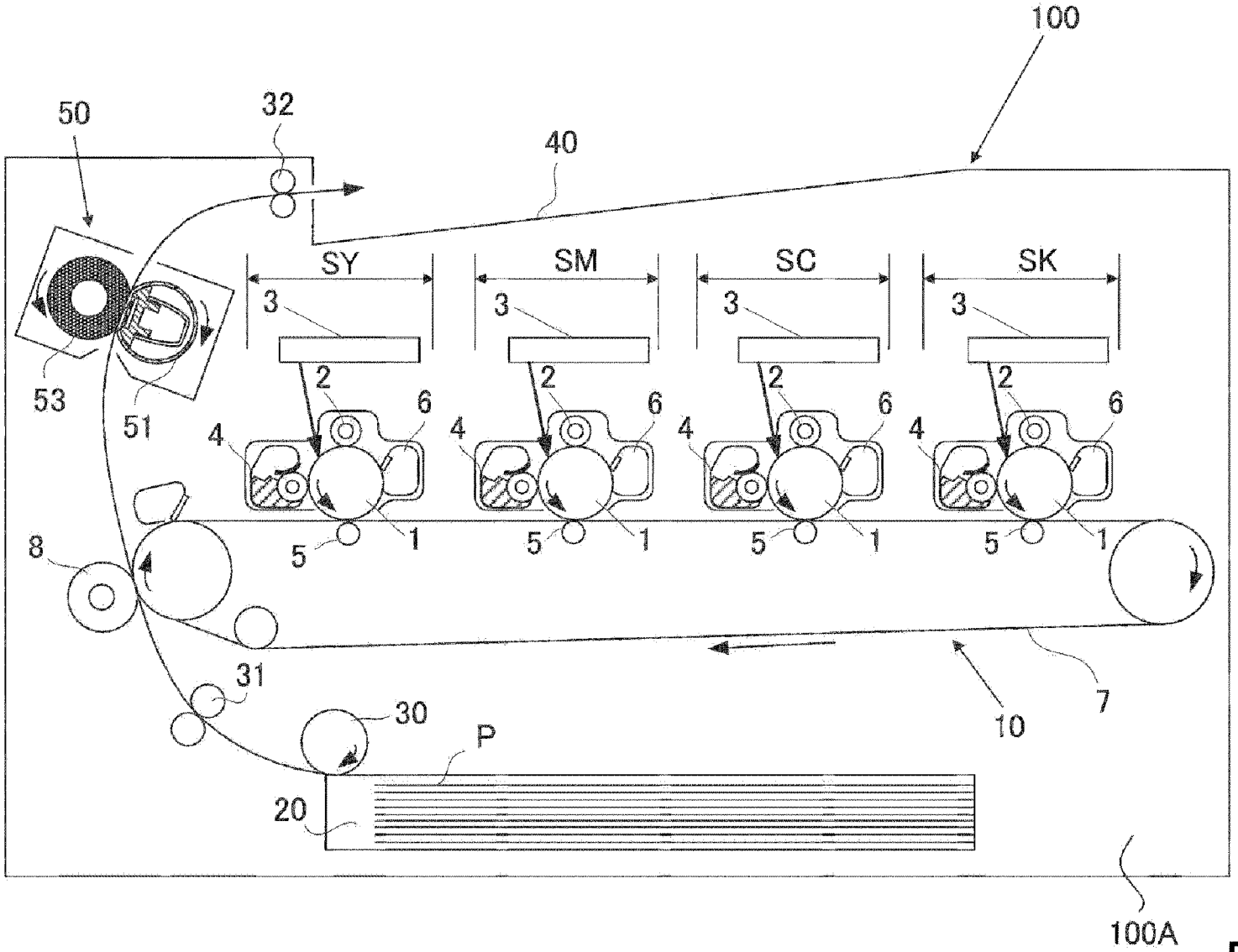

FIG. 11 is a sectional view showing a schematic structure of an image forming apparatus.

DESCRIPTION OF EMBODIMENTS

Embodiments of the present invention will be described with reference to the drawings. Although these embodiments are preferred embodiments of the present invention, the present invention is not limited to the following embodiments, but constitutions thereof can be replaced with other various constitutions within a scope of a concept of the present invention.

(1) Image Forming Apparatus 100

With reference to FIG. 11, an image forming apparatus 100 according to an embodiment of the present invention will be described. FIG. 11 is a sectional view showing a general structure of the image forming apparatus (a full-color printer in this embodiment) 100 using an electrophotographic recording technique. A process speed of the image forming apparatus 100 in this embodiment is 180 mm/s.

In the image forming apparatus 100, an image forming portion 10 for forming images on recording material P with toners includes four image forming stations SY, SM, SC and SK for yellow, magenta, cyan and black, respectively. Each of the image forming portions includes a photosensitive drum 1, a charging member 2, a laser scanner 3, a developing device 4, a transfer member 5 and a cleaner 6 for cleaning an outer peripheral surface of the photosensitive drum 1.

The image forming portion 10 further includes a belt 7 for feeding toner images transferred from the respective photosensitive drums 1 by the transfer members 5 while carrying the toner images, and includes a secondary transfer member 8 for transferring the toner images from the belt onto the recording material P. An operation of the image forming portion 10 is well known, and therefore, will be omitted from detailed description.

Recording materials P accommodated in a cassette 20 in an apparatus main assembly 100A are supplied to a roller pair 31 one by one by rotation of a roller 30. The recording material P is fed, by rotation of the roller pair 31, to a secondary transfer portion formed by the belt 7 and the secondary transfer member 8, and at the secondary transfer portion, the toner image is transferred onto the recording material P. The recording material P carrying thereon unfixed toner images is sent to a fixing device 50 as a fixing portion, and the toner image is heat-fixed on the recording material P by the fixing device 50. The recording material P coming out of the fixing device 50 is discharged onto a tray 40 by rotation of a roller pair 32.

(2) Fixing Device 50

Figure 1:
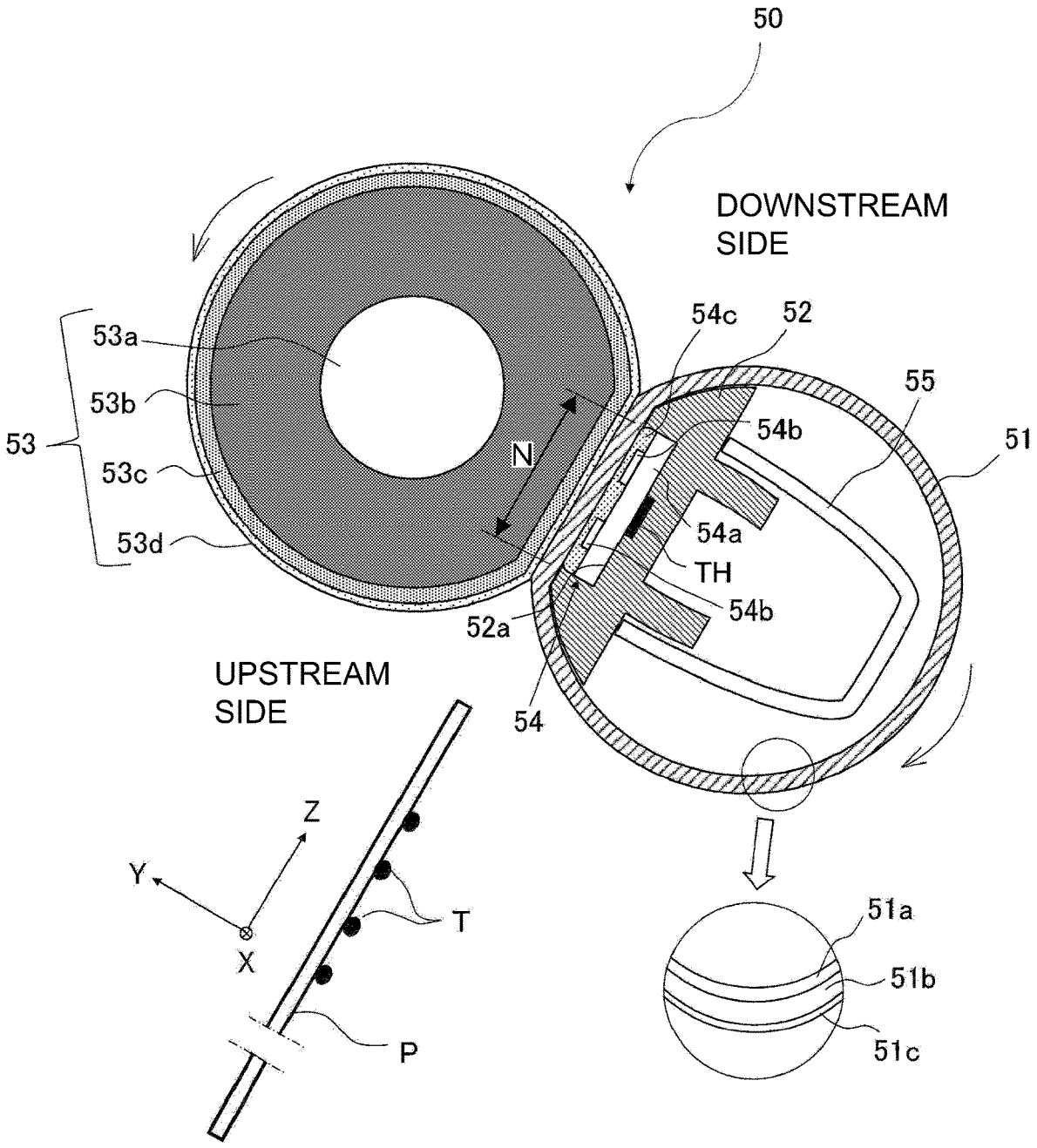
FIG. 1 is a sectional view showing a schematic structure of a fixing device.
Figure 2:
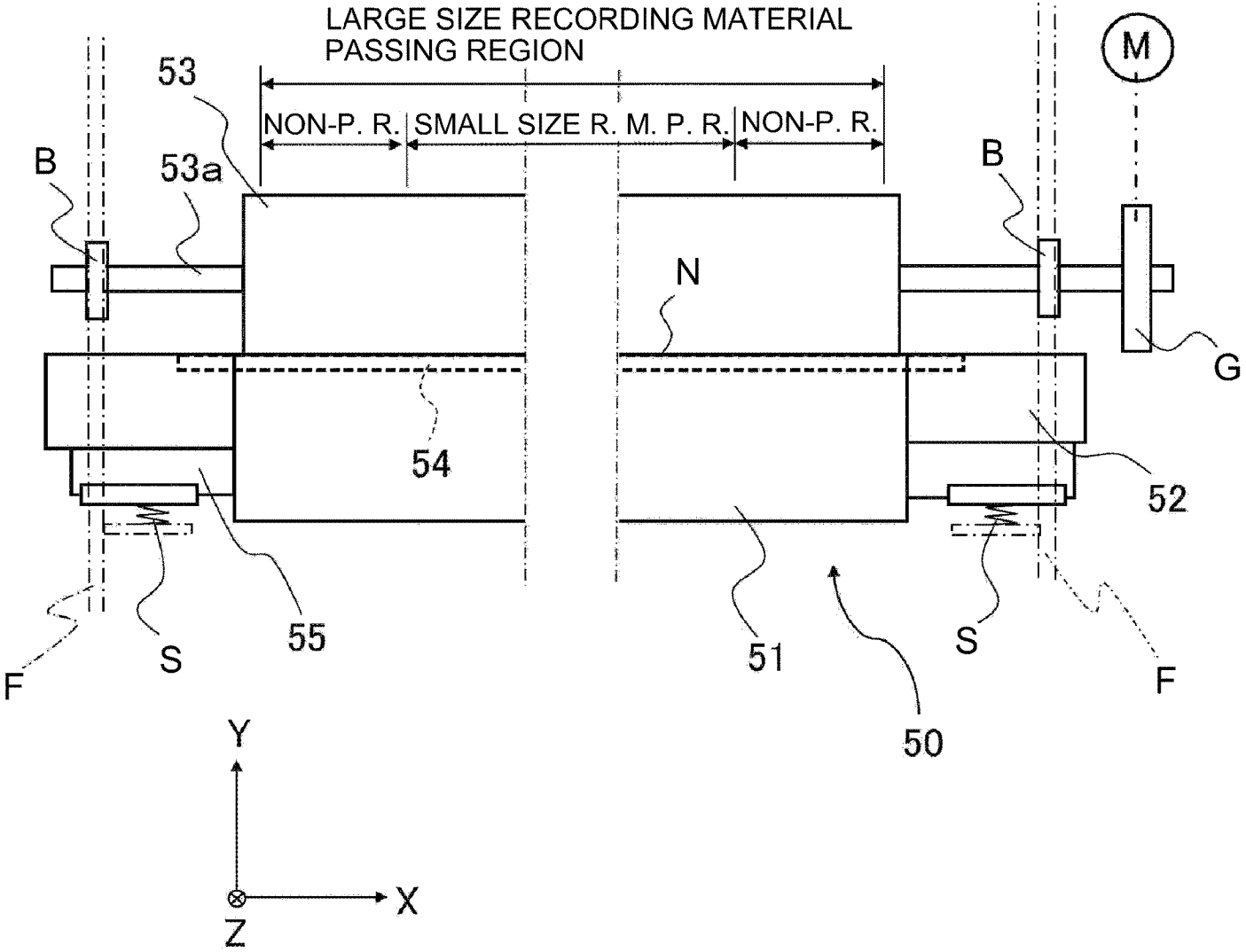
FIG. 2 is a schematic view of the fixing device as seen from an upstream side of a recording material feeding direction.

Then, the fixing device 50 will be described with reference to FIGS. 1 and 2. FIG. 1 is a sectional view showing a schematic structure of an entirety of the fixing device 50. FIG. 2 is a schematic view of the fixing device 50 as seen from an upstream side of a recording material feeding direction Z.

In FIG. 2, a central portion of the fixing device 50 is omitted from illustration with respect to a direction X perpendicular to the recording material feeding direction Z.

The fixing device 50 includes a cylindrical film 51 as a heating member and a pressing roller 53 as a pressing member for forming a nip N in contact with an outer peripheral surface of the film 51. The fixing device 50 further includes a ceramic heater 54 as a heating member for heating the film 51 in contact with an inner peripheral surface of the film 51, a holder 52 as a supporting member for supporting the heater 54, and a stay 55 as a reinforcing member for reinforcing the holder 52.

The film 51 includes a cylindrical base layer 51*a*, an elastic layer 51*b* provided on an outer peripheral surface of the base layer 51*a*, and a parting layer 51*c* provided on an outer peripheral surface of the elastic layer 51*b*. As regards materials of the respective layers, the base layer 51*a* is made of polyimide, the elastic layer 51*b* is made of a silicone rubber, and the parting layer 51*c* is made of PFA (tetrafluoroethylene-perfluoroalkyl vinyl ether copolymer). As regards thicknesses of the respective layers, the base layer 51*a* has the thickness of 50 the elastic layer 51*b* has the thickness of 200 and the parting layer 51*c* has the thickness of 20 μm. An outer diameter of the film 51 is 18 mm.

The holder 51 inserted in a hollow portion of the film 51 is a member having rigidity, a heat-resistant property and a heat-insulating property, and is made of a liquid crystal polymer. With respect to the direction X, the holder 52 includes a recessed portion 52*a* at a flat surface on the roller 53 side, and supports the heater 54 by this recessed portion 52*a*. The holder 52 also has a function as a guiding member for guiding rotation of the film 51.

The heater 54 includes an elongated substrate 54*a*. On a surface of the substrate 54*a* on the roller 53 side, a heat generating resistance layer 54*b* which is a heat generating resistor generating heat by energization and which is made of silver-palladium is provided along a longitudinal direction of the substrate 54*a*. Further, on the surface of the substrate 54*a* on the roller 53 side, a glass layer 54*c* as a protective layer for covering the heat generating resistance layer 54*b* is provided for ensuring insulation and an anti-wearing property of the heat generating resistance layer 54*b*.

At the hollow portion of the film 51, the stay 55 is provided on a surface of the holder 52 on a side opposite from the surface of the holder 52 on the roller 53 side. The stay 55 has a function of reinforcing the holder 52.

The roller 53 includes a core metal 53*a* made of iron, aluminum or the like, an elastic layer (second elastic layer) 53*b* provided on an outer peripheral surface of the core metal 53*a*, a thermally conductive layer (first elastic layer) 53*c* as an adhesive layer provided on an outer peripheral surface of the elastic layer 53*b*, and a parting layer (surface layer) 53*d* provided on an outer peripheral surface of the thermally conductive layer 53*c*. Materials and manufacturing methods of the elastic layer 53*b*, the thermally conductive layer 53*c* and the parting layer 53*d* will be described in a subsequent section (3) specifically.

As shown in FIG. 2, with respect to the direction X, by left and right frames F of the fixing device 50, both end portions of the core metal 53*a* of the roller 53 are rotatably supported via bearings B. Further, by the frames F, both end portions of the holder 52 and both end portions of the stay 55 are supported.

The both end portions of the stay 55 are pressed by springs S in a direction (recording material thickness direction Y) perpendicular to a generatrix direction of the film 51. By this pressure, the holder 52 presses the heater 54 against the inner surface of the film 51, so that the film surface is press-contacted with an outer peripheral surface of the roller 53. As a result, the elastic layer 53*b* of the roller 53 is depressed and elastically deformed, so that the nip N having a predetermined width with respect to the recording material feeding direction Z is formed by the roller surface and the film surface.

A heat-fixing process operation will be described.

When a gear G provided at one end portion of the core metal 53*a* of the roller 53 is rotationally driven by a motor member (FIG. 2), the roller 53 is rotated in an arrow direction of in FIG. 1. The film 51 is rotated in an arrow direction in FIG. 1 by rotation of the roller 53 while the inner surface thereof slides on the glass layer 54*c* of the heater 54. In order to reduce a frictional force generating between the film 51 and the holder 52 and between the film 51 and the heater 54 by rotation of the film 51, grease (not shown) is applied onto the inner surface of the film 51.

When electric power is supplied from an unshown power (voltage) source to the heat generating resistance layer 54*b* of the heater 54, the heat generating resistance layer 54*b* generates heat, so that the heater 54 is abruptly increased in temperature. A temperature controller (not shown) controls electric power supply to the heater 54 so that a temperature of the heater 54 detected by a thermistor TH as a temperature detecting member supported by the holder 52 is maintained at a predetermined fixing temperature (target temperature).

The recording material P carrying unfixed toner images T thereon is heated while being fed through the nip N, whereby the toner images are fixed on the recording material P.

(3) Roller 53

The respective layers of the roller 53 will be described with reference to FIGS. 3 and 4. Part (a) of FIG. 3 is a perspective view of the roller 53, and part (b) of FIG. 3 is a sectional view showing a layer structure of the roller 53.

(3-1) Elastic Layer 53*b*

A thickness of the elastic layer 53*b* is not particularly limited if the nip N having the predetermined width with respect to the recording material feeding direction Z can be formed, but may preferably be 2-10 mm. Here, the thickness refers to a dimension of the roller 53 with respect to a radial direction of the roller 53.

As a material of the elastic layer 53*b*, a general-purpose heat-resistant solid rubber such as a silicone rubber, or foam sponge rubber or the like can be used. These rubbers have sufficient heat-resistant property and durability and preferred elasticity (softness) in the case where the rubbers are used in the fixing device 50. Accordingly, the general-purpose heat-resistant solid rubber such as the silicone rubber or the foam sponge rubber is suitable as a main material of the elastic layer 53*b*.

A method of forming the elastic layer 53*b* is not particularly limited, but a general molding method can be suitably used.

(3-2) Thermally Conductive Layer 53*c*

The thermally conductive layer 53*c* is provided between the elastic layer 53*b* and the parting layer 53*d*. FIG. 4 is a photograph of a cut portion of the thermally conductive layer 53*c* with respect to the thickness direction when the thermally conductive layer 53*c* is observed through a scanning electron microscope. In FIG. 4, C represents a circumferential direction of the roller 53, and O represents an orientation direction of fillers 53*g*. Incidentally, although the kind of the fillers will be described later, the filler subjected to surface coating is referred to as a filler 53*g*, and the filler which is not subjected to the surface coating is referred to as a filler 53*j*. Further, fillers 53*g* collected in a bundle shape are referred to as a filler bundle 53G.

As shown in FIG. 4, the thermally conductive layer 53*c* includes a base material 53*e* and fiber-like thermally conductive fillers 53*g* (more accurately the filler bundle 53G) contained in the base material 53*e*. As the base material 53*e*, a heat-resistant rubber material containing an adhesive component or a heat-resistant rubber material containing no adhesive component is used. As the heat-resistant rubber material containing the adhesive component, an addition-curable silicone rubber adhesive can be used. Specifically, the addition-curable silicone rubber adhesive contains an organopolysiloxane having an unsaturated hydrocarbon group represented by a vinyl group, and a hydrogen organopolysiloxane and a platinum compound as a cross-linking catalyst. Further, the organopolysiloxane, the hydrogen organopolysiloxane and the platinum compound are cured by addition reaction. As such an adhesive, an already-known adhesive can be used.

Examples of a self-adhesive component include the following compounds:

a) silane having at least one functional group, preferably two or more functional groups, selected from the group consisting of alkenyl group such as vinyl group, (meth-) acryloxy group, hydrosilyl group (SiH group), epoxy group, alkoxysilyl group, carbonyl group, and phenyl group, b) organosilicon compounds such as cyclic or linear siloxanes having 2-30 silicon atoms, preferably 4-20 silicon atoms, and c) non-silicon-based organic compounds which contain 1-4 aromatic rings, per (one) molecule, having monovalent to tetravalent phenylene structures or the like and which contain at least one functional group, per (one) molecule, capable of contributing to hydrosilylation addition reaction (and which may also contain an oxygen atom in one molecule).

Here, as regards the aromatic rings having monovalent to tetravalent phenylene structures, aromatic rings having divalent to tetravalent phenylene structures are preferred. Further, as regards the 1-4 aromatic rings such as the phenylene structures contained in one molecule of the non-silicon-based organic compound, it is preferable that one or two aromatic rings such as the phenylene structures are contained in one molecule of the non-silicon-based organic compound. As the functional group capable of contributing to the hydrosilylation addition reaction, for example, alkenyl group, (meth-)acryloxy group or the like group are used. Further, as regards the functional group capable of contributing to the hydrosilylation addition reaction, it is preferable that two to four functional groups are contained in one molecule of the non-silicon-based organic compound. In the non-silicon-based organic compound, the term "non-silicon-based" refers to a type in which a silicon atom is not contained in one molecule. As regards the above-described self-adhesive component, a single self-adhesive component can be used, or two or more self-adhesive components can also be used in combination. The above-described addition-curable silicone rubber adhesive is also commercially available and thus is easily available.

As the heat-resistant rubber material containing no adhesive component, a heat-resistant rubber material such as a silicone rubber or a fluorine-containing rubber can be used. In the case where the silicone rubber is used as the heat-resistant rubber material containing no adhesive component, an addition-curable silicone rubber is preferred from the viewpoints of ease of availability and ease of processability.

The filler 53*g* has a function as a filling material (filler) for ensuring thermal conductivity of the thermally conductive layer 53*c*. A heat flow path can be formed in the base material 53*e* by dispersing the fillers 53*g* in the silicone rubber adhesive which is the base material 53*e* or in the silicone rubber. Further, the fillers 53*g* may preferably have an elongated fiber shape. By using the fiber-shaped fillers 53*g*, when the fillers 53*g* are kneaded with a liquid silicone rubber adhesive or a liquid silicone rubber before curing, the fillers 53*g* are easily oriented in a flowing direction, i.e., in the direction X during molding. For that reason, with respect to the direction X, the thermal conductivity of the pressing roller 53 can be enhanced.

FIG. 5 is a perspective view of the fixing device 50 showing a state in which a small size recording material is fed through the nip N. As shown in FIG. 5, with respect to the direction X, the recording material is shorter than a length of the heat generating resistance layer 54*b* of the heater 54, and therefore, on both sides of a passing region where the recording material passes through the nip N, non-passing regions where the recording material does not pass through the nip N generate. Here, the heat is taken by the recording material, and therefore, the passing region is a low-temperature portion, and the non-passing regions where the heat is not taken by the recording material are high-temperature portions.

The heat is accumulated in the non-passing regions by continuous passing of the recording materials, and thus is increased in temperature more and more. At this time, by the thermally conductive layer 53*c* of the roller 53, efficient heat dissipation from the high-temperature portions (non-passing regions) toward the low-temperature portion (passing portion) can be carried out. This is because the heat dissipation can be carried out by using a full circumference of the roller 53 through rotation of the roller 53.

In order to effectively carry out the heat dissipation, as in this embodiment, the thermally conductive layer 53*c* may desirably be disposed between the elastic layer 53*b* and the parting layer 53*d*. The reason therefor is that a portion where a temperature difference between the non-passing region and the passing region of the recording material is maximum is the surface of the parting layer 53*d* and therefore an effect of the heat dissipation is easily achieved at a position closer to the parting layer 53*d*.

Further, in order to carry out the heat dissipation in the direction X, the fillers 53*g* may desirably be oriented in an in-plane direction, not in a thickness direction of the thermally conductive layer 53*c*. Here, the in-plane direction refers to a direction parallel to the direction X or a direction substantially parallel to the direction X.

Part (a) of FIG. 6 is a sectional view of the thermally conductive layer 53*c* containing short fillers 53*h* with respect to the direction Y, and part (b) of FIG. 6 is a sectional view of the thermally conductive layer 53*c* containing a long filler 53*g* with respect to the direction X.

Part (a) of FIG. 6 is the sectional view showing the case of (length (100 μm) of fillers 53*h*)<(thickness (200 μm) of thermally conductive layer 53*c*), and the fillers 53*h* are very short, and therefore, part (a) of FIG. 6 shows that the fillers 53*h* are also oriented in the thickness direction of the thermally conductive layer 53*c* when the thermally conductive layer 53*c* is molded. Part (b) of FIG. 6 is the sectional view showing the case of (length (2 mm) of fillers 53*g*)>(thickness (200 μm) of thermally conductive layer 53*c*) as in this embodiment, and part (b) of FIG. 6 shows that the fillers 53*g* cannot be oriented in the thickness direction of the thermally conductive layer 53*c* and are easily oriented in the in-plane direction.

Thus, in the case where the fillers 53*g* are intended to be oriented in the in-plane direction of the thermally conductive layer 53*c*, a relationship of (length of fillers 53*g*)>(thickness of thermally conductive layer 53*c*) (hereinafter referred to as a relational expression 1) may desirably be satisfied.

Further, in order to increase a heat transfer amount of the thermally conductive layer 53*c* in the direction X, the thickness of the thermally conductive layer 53*c* may preferably be made thick, and for that purpose, it is desirable that the length of the fillers 53*g* is selected so as to satisfy the relational expression 1.

A molding method of the thermally conductive layer 53*c* is not particularly limited, but in general, it is possible to use molding methods of a die molding type, a coat molding type and the like. Further, it is also possible to use a ring coating method as disclosed in JP-A 2003-190870 and JP-A 2004-290853. By the above-described various methods, the thermally conductive layer 53*c* can be formed in a seamless shape on the outer peripheral surface of the elastic layer 53*b*. As regards the thickness of the thermally conductive layer 53*c*, 0.1-5 mm may preferably be used from the viewpoints of not only performance but also molding.

Parts (a) to (d) of FIG. 7 are sectional views of the case where the filler 53*g* or the filler bundles 53G are cut along an X-C plane. Part (a) of FIG. 7 is the sectional view of a single filler 53*g*, part (b) of FIG. 7 is the sectional view of three fillers 53*g* collected in a bundle shape, part (c) of FIG. 7 is the sectional view of eight fillers 53*g* which are shown in FIG. 4 and which are collected in a bundle shape, and part (d) of FIG. 7 is the sectional view of six fillers 53*g* collected in a bundle shape.

The fillers 53*g* used in this embodiment are carbon fibers of about 9 μm in diameter. An outer peripheral surface of the filler 53*g* is coated with a binder (adhesive) 53*i*. As a result, the fillers 53*g* can be bonded to each other by the binder 53*i*, and therefore, the fillers 53*g* can be collected in the bundle shape as in the filler bundle 53G. The binder 53*i* used in this embodiment is an epoxy resin (material).

As a pattern of collecting the fillers 53*g* in the bundle shape, as shown in part (b) of FIG. 7, the case where a bundle of fillers 53*g*-1, 53*g*-2 and 53*g*-3 each contacting adjacent two fillers on their outer peripheral surfaces is a basic bundle exists. Further, by repetition of the basic bundle, a skeleton of a bundle as shown in part (c) of FIG. 7 is formed.

Alternatively, as shown in part (d) of FIG. 7, the case where a state in which a filler 53*g*-4 contacts adjacent two fillers 53*g*-5 and 53*g*-6 on its outer peripheral surface, but the fillers 53*g*-5 and 53*g*-6 do not contact each other is a basic bundle exists.

That is, in either case of parts (c) and (d) of FIG. 7, a basic filler bundle 53G in which at least two fillers 53*g* are contacted to a single filler 53*g* constitutes a core, so that a plurality of the filler 53*g* or filler bundle 53G get together.

In the case where the length of the filler 53*g* is short, i.e., several tens of μm to several hundreds of the single filler 53*g* cannot transfer (transport) heat long, so that a high thermally conductive property is not readily obtained in the thermally conductive layer 53*c*. On the other hand, in the case where the length of the filler 53*g* is long, i.e., 1 mm or more, an opportunity of contact between the fillers 53*g* increases and the single filler 53*g* can transfer heat long, and therefore, the high thermally conductive property is readily obtained.

However, when long-fiber fillers 53*j* each not coated with the binder 53*i* and each having a length of 1 mm or more and the base material 53*e* are intended to be kneaded with each other, the fillers 53*j* are entangled with each other, so that a viscosity of a kneaded product becomes high. For that reason, in a process of the kneading, the long fillers 53*j* were broken into short fillers in some instances.

On the other hand, as in this embodiment, when the filler bundle 53G in which a plurality of fillers 53*g* each surface-coated with the binder 53*i* are collected in the bundle shape is used, the fillers 53*g* are not readily flexed (bent) when the filler bundle 53G and the base material 53*e* are kneaded with each other, and therefore, entanglement of the fillers 53*g* with each other can be suppressed. Further, compared with the fillers 53*j* which are not collected in the bundle shape, the filler bundle 53G decreases in contact area with the base material 53*e*, so that the viscosity thereof can be lowered. For that reason, the fillers 53*j* in the filler bundle 53G can be dispersed in the base material 53*e* while being kept in the long-fiber state of 1 mm or more.

Further, also from the viewpoint of obtaining a good fixing property, for the reason described below, compared with the case where the fillers 53*j* which are not collected in the bundle shape are used, the case where the filler bundle 53G is used as in this embodiment is excellent.

As one means for obtaining the good fixing property, a constitution in which the nip N having a broad width with respect to the recording material feeding direction Z is formed by decreasing hardness of the roller 53 would be considered. This is because a time in which the heat of the heater 54 is transmitted to the recording material P via the film 51 becomes longer with a broader width of the nip N.

That is, in the case where the fillers 53*j* which are not collected in the bundle shape were used, the hardness of the roller 53 is high and the width of the nip N is narrow, so that the good fixing property was not obtained. On the other hand, in the case where the filler bundle 53G is used as in this embodiment, the hardness of the roller 53 can be lowered, and therefore, the nip N having the broad width and the good fixing property were able to be obtained. A mechanism of this will be described using FIGS. 8 and 9.

Parts (a) and (b) of FIG. 8 are schematic views showing an orientation of the fillers 53*j* which are dispersed in the thermally conductive layer 53*c* and which are not collected in the bundle shape. Parts (a) and (b) of FIG. 9 are schematic views showing an orientation of the filler bundles 53G dispersed in the thermally conductive layer 53*c*. Each of parts (a) and (b) of FIG. 8 and parts (a) and (b) of FIG. 9 shows an orientation state of the fillers 53*j* (or the filler bundles 53G) in a region 53*n* of the roller 53 shown in part (a) of FIG. 3.

Part (a) of FIG. 8 shows a state in which the fillers 53*j* are oriented in the direction X of the roller 53. However, all the fillers 53*j* are not always oriented in the direction X, but the fillers 53*j* dispersed in an inclined state in a circumferential direction C of the roller 53 also exist. For that reason, the fillers 53*j* oriented in the direction X and the fillers 53*j* inclined in the circumferential direction C cross at a plurality of positions, so that an effect of reinforcing the thermally conductive layer 53*c* is achieved.

As a result, as shown in part (b) of FIG. 8, when a force of flexing the thermally conductive layer 53*c* in the circumferential direction C of the roller 53 is applied, the thermally conductive layer 53*c* is not readily flexed by the above-described reinforcing effect, so that the hardness of the roller 53 became high.

On the other hand, in the case of this embodiment, as shown in part (a) of FIG. 9, the filler bundles 53G each collected in the bundle shape by combining the fillers 53*g* by the binder 53*i* are used, and therefore, the fillers 53*g* can be dispersed with intervals therebetween compared with the case of part (a) of FIG. 8. For that reason, although some fillers 53*g* are dispersed in the inclined state in the circumferential direction C similarly as in the case of part (b) of FIG. 8, the fillers 53*j* are disposed with intervals from adjacent fillers 53*j* oriented in the direction X, and therefore, the reinforcing effect is not readily achieved.

As a result, as shown in part (b) of FIG. 9, when a force of flexing the thermally conductive layer 53*c* in the circumferential direction C of the roller 53 is applied, a good flexing property is obtained, so that the hardness of the roller 53 was able to be lowered while maintaining the thermal conductivity comparable to the thermal conductivity in the case where the fillers 53*j* which are not collected in the bundle shape were used.

(3-3) Parting Layer (Surface Layer) 53*d*

The parting layer 53*d* is formed by coating a PFA tube on the outer peripheral surface of the thermally conductive layer 53*c*. A thickness of the parting layer 53*d* is not particularly limited if the thickness permits impartation of a sufficient parting property to the roller 53, but may preferably be 20-100 μm.

(3-4) Embodiments of Roller

Filler bundles 53G and fillers 53*j* used in rollers according to Embodiments 1 and 2 and rollers according to Comparison Examples 1 and 2, respectively, are shown in Table 1 below. As the filler bundles 53G and the fillers 53*j*, the following pitch-based carbon fibers manufactured by Nippon Graphite Fiber Co., Ltd. were used. Carbon fibers of trade names XN-80C-02S and XN-80C-01S are the filler bundles 53G, and carbon fibers of trade names XN-80C-02 and XN-80C-01 are the fillers 53*j* which are not subjected to coating.

TABLE 1

| Trade name | Sizing agent | AFD*1 (μm) | AFL*2 (mm) | TC*3 (W/m · K)) |
|---|---|---|---|---|
| XN-80C-02S | Epoxy*4 | 9 | 2 | 320 |
| XN-80C-01S | Epoxy*4 | 9 | 1 | 320 |
| XN-80C-02 | — | 9 | 2 | 320 |
| XN-80C-01 | — | 9 | 1 | 320 |

*1"AFD" is an average fiber diameter.
*2"AFL" is an average fiber length.
*3"TC" is thermal conductivity.
*4"Epoxy" is the epoxy resin (material).

In Table 1, the sizing agent refers to a coating agent (material) for the carbon fibers and corresponds to the binder 53*i* described in this embodiment. In commodity products coated with the sizing agent, outer peripheral surfaces of the carbon fibers are coated with the epoxy resin in an amount of 2 wt. % per (one) carbon fiber.

Manufacturing Methods of Rollers of Embodiments and Comparison Examples

Embodiment 1

First, on an outer peripheral surface of a core metal 53*a* made of aluminum in a diameter of 13 mm, a 3.5 mm-thick elastic layer 53*b* is formed by a die molding method by using an addition-curable silicone rubber of 1.20 g/cm$^3$ in density. As a result, an elastic layer-coated product 1 of 20 mm in diameter is obtained. Here, a temperature condition during cross-linking of the silicone rubber is 150° C.×30 minutes.

Next, a molding method of a thermally conductive layer 53*c* in which a silicone rubber adhesive is used as a base material will be described. An adhesive undiluted solution is obtained by mixing A liquid and B liquid of an addition-curable silicone rubber adhesive (trade name: SE1819CV A&C, manufactured by Dow Corning Tory Co., Ltd.) in a mixing ratio of 1:1. The adhesive undiluted solution is not limited thereto, but another adhesive undiluted solution may also be used.

With this adhesive undiluted solution, the pitch-based carbon fiber XN-80C-02S which is a fiber-like thermally conductive filler bundle 53G in which the fillers are coated with the epoxy resin and are collected in the bundle shape was uniformly added and kneaded so as to be 15% in volume ratio, so that an adhesive composition 1 was obtained. This adhesive composition 1 was uniformly applied onto an outer peripheral surface of the above-described elastic layer-coated product 1 in a thickness of 200 μm.

Then, on an outer peripheral surface of the adhesive composition 1, as a parting layer 53*d*, a PFA tube (thickness: 50 μm) was coated and heat-cured at 200° C. for 10 minutes.

Comparison Example 1

First, similarly as in Embodiment 1, the 3.5 mm-thick elastic layer 53*b* is formed, so that the elastic layer-coated product 1 of 20 mm in diameter is obtained.

Next, a molding method of a thermally conductive layer 53*c* in which a silicone rubber adhesive is used as a base material will be described. With the adhesive undiluted solution which is the same as that in Embodiment 1, the pitch-based carbon fiber XN-80C-02 in which the fillers are not coated with the epoxy resin was uniformly added and kneaded so as to be 15% in volume ratio, so that an adhesive composition 2 was obtained. However, in the carbon fibers are not coated with the epoxy resin and are not collected in the bundle shape, and therefore, as described above, the carbon fibers are entangled with each other, so that the carbon fibers were in a state in which the carbon fibers were not readily kneaded with the adhesive undiluted solution.

Therefore, when a stirring step in which a degree of stirring was stronger than that in Embodiment 1 was performed, a part of the carbon fibers contained in the adhesive composition after the kneading was shortened in length. These adhesive composition 2 was uniformly applied onto an outer peripheral surface of the above-described elastic layer-coated product 1 in a thickness of 200 μm.

Then, on an outer peripheral surface of the adhesive composition 2, as a parting layer 53*d*, a PFA tube (thickness: 50 μm) was coated and heat-cured at 200° C. for 10 minutes.

Embodiment 2

First, on an outer peripheral surface of a core metal 53*a* made of aluminum in a diameter of 13 mm, a 2.7 mm-thick elastic layer 53*b* is formed by a die molding method by using an addition-curable silicone rubber of 1.20 g/cm$^3$ in density, so that an elastic layer-coated product 2 of 18.4 mm in diameter is obtained. Here, as a temperature condition, the silicone rubber was heat-cured at 150° C. for 30 minutes.

Next, a molding method of a thermally conductive layer 53*c* in which a heat-resistant rubber material containing no adhesive component is used as a base material will be described. As the heat-resistant rubber material containing no adhesive component, an addition-curable silicone rubber undiluted solution is used.

With this addition-curable silicone rubber undiluted solution, the pitch-based carbon fiber XN-80C-01S which is a filler bundle 53G in which the fillers are coated with the epoxy resin was uniformly added and kneaded so as to be 7% in volume ratio, so that a silicone rubber component 1 was obtained.

Then, in a mold of 20.4 mm in diameter, the elastic layer-coated product 2 of 18.4 mm in diameter was set so that the core metal was the same. Then, between the metal mold and the elastic layer-coated product 2, the silicone rubber component 1 was injected, followed by heat-curing at 150° C. for 60 minutes, so that an elastic layer-coated product 3 which included a 1 mm-thick thermally conductive layer 53*c* and which has a diameter of 20.4 mm was obtained.

Then, on an outer peripheral surface of the elastic layer-coated product 3, as a parting layer 53*d*, a PFA tube (thickness: 50 μm) was coated.

Embodiment 3

First, similarly as in Embodiment 2, the 2.7 mm-thick elastic layer 53*b* is formed, so that the elastic layer-coated product 2 of 18.4 mm in diameter is obtained.

Next, a molding method of a silicone rubber-based highly thermally conductive layer 53*c* will be described.

With this addition-curable silicone rubber undiluted solution which is the same as that in Embodiment 2, the pitch-based carbon fiber XN-80C-01 in which the fillers are not coated with the epoxy resin was uniformly added and kneaded so as to be 7% in volume ratio, so that a silicone rubber component 2 was obtained.

However, the fillers were not coated with the epoxy resin, and therefore, as described above, the pitch-based carbon fiber XN-80C-01 was in a state of being not readily kneaded with the addition-curable silicone rubber undiluted solution.

Then, in a mold of 20.4 mm in diameter, the elastic layer-coated product 2 of 18.4 mm in diameter was set so that the core metal was the same. Then, between the metal mold and the elastic layer-coated product 2, the silicone rubber component 2 was injected, followed by heat-curing at 150° C. for 60 minutes, so that an elastic layer-coated product 4 which included the thermally conductive layer 53*c* and which has a diameter of 20.4 mm was obtained.

Then, on an outer peripheral surface of the elastic layer-coated product 4, as a parting layer 53*d*, a PFA tube (thickness: 50 μm) was coated.

[Performance Evaluation]

<Hardness>

The material was measured using an ASKER-C hardness meter ("ASKER Durometer Type C", manufactured by KOBUNSHI KEIKI CO., LTD.) according to standards of JIS K7312 and SRIS0101.

FIG. 10 is a schematic view showing hardness measuring points of the roller 53 with respect to a direction perpendicular to the recording material feeding direction Z. After the roller 53 is molded, in a region indicated by "a", a surface of the thermally conductive layer 53*c* and a surface of the elastic layer 53*b* were obtained by abrading (rubbing) the roller 53 with sandpaper from the outer peripheral surface of the parting layer 53*d*. The hardness was measured at each of measuring points "b1", "b2" and "b3" by the ASKER-C hardness meter, so that the hardness of the roller 53 in a completed state, the hardness in a region in which the thermally conductive layer 53*c* was molded on the elastic layer 53*b*, and the hardness of the elastic layer 53*b* were evaluated.

<Nip Width>

In a state in which the pressure applied from the springs S to the fixing device 50 is eliminated, a pressure-sensitive paper ("PRESCALE", manufactured by Fujifilm Holdings Corporation) was sandwiched between the surface of the roller 53 and the surface of the film 51, and thereafter, a predetermined pressure was applied to the fixing device 50 by the springs S. The pressure applied from the springs S to the fixing device 50 was eliminated again, and then the pressure-sensitive paper was pulled out. From a change in color of the pressure-sensitive paper, a width of the nip N with respect to the recording material feeding direction Z in a pressed state of the fixing device 50 was measured.

(Fixing Property)

The fixing property and an overheating suppression performance in a non-passing region of the recording material below were evaluated by carrying out printing at a process speed of 180 mm/s and at a fixing temperature of 200° C.

The fixing property was evaluated in a manner such that a test pattern of 5 mm square was printed on A4 size paper (80 g/m$^2$) and was rubbed with lens-cleaning paper and then a density change rate of the test pattern before and after the rubbing was measured.

o: average density change rate of less than 20% x: average density change rate of 20% or more

In the case where the average density change rate is 20% or more, when the test pattern is rubbed with finger(s) or the like, an image defect such as a lack of the image occurs, and therefore, the average density change (lowering) rate may desirably be less than 20%.

(Overheating Suppression in Non-Passing Region)

A length of the heat generating resistance layer 54*b* of the heater 54 is 220 mm. A paper width (a length with respect to the direction X) of the A4 size paper is 210 mm, and therefore, recording material non-passing regions each of 5 mm generate on both sides of the A4 size paper. Therefore, a surface temperature of the film 51 in the non-passing regions when images are continuously printed on 300 sheets of the A4 size paper (80 g/m$^2$) was measured. In this embodiment, an overheating suppression effect in the non-passing regions was evaluated at the following two levels.

o: temperature in non-passing regions of less than 230° C.

x: temperature in non-passing regions of 230° C. or more

When the surface temperature of the film 51 in the recording material non-passing regions exceeds 230° C., the hardness of the elastic layer 51*b* of the film 51 increases in some instances. As a result, with respect to the direction X, hardness non-uniformity of the elastic layer 51*b* of the film 51 occurs, so that there is a liability that improper feeding occurs. Accordingly, the temperature of the film 51 in the non-passing regions may desirably be less than 230° C.

(Result of Evaluation)

A list of an evaluation result is shown in Table 2 appearing hereinafter. In the rollers 53 according to Embodiment 1, Comparison Example 1, Embodiment 2 and Comparison Example 2, values of the hardness at the measuring point "b3" were 32°.

In the roller 53 according to Embodiment 1, the hardness at the measuring point "b2" is 39°, so that an increase in hardness is only 7% with respect to the hardness at the measuring point "b3". This is because as described above, by collecting the fillers (carbon fibers) 53*g* contained in the thermally conductive layer 53*c* in the bundle shape, the thermally conductive layer 53*c* is readily flexed in the circumferential direction as shown in FIG. 9. As a result, the hardness at the measuring point "b1" was 52° and the nip width was able to be extended to 8 mm, so that a good fixing property such that the average density lowering rate was 13% was able to be obtained. The temperature of the film 51 in the recording material non-passing regions was 225° C., so that a sufficient overheating suppression effect was achieved.

In the roller 53 according to Comparison Example 1, the hardness at the measuring point "b2" was 46° and was largely increased by 14° with respect to the hardness at the measuring point "b3". As a result, the hardness at the measuring point "b1" was 57° and the nip width was narrowed to 6 mm, so that improper fixing occurred (average density lowering rate: 25%).

Further, the temperature of the film 51 in the non-passing regions was 235° C. and was higher than that in Embodiment 1.

In the roller 53 according to Embodiment 2, by an effect of collecting the fillers (carbon fibers) 53*g* in the bundle shape similarly as in Embodiment 1, the hardness at the measuring point "b2" is 39°, and the hardness at the measuring point "b1" was 52°, so that the nip width of 8 mm was able to be ensured. Further, the fixing property was good, and the average density lowering rate was 13%. Further, the temperature of the film 51 in the recording material non-passing regions was 225° C., so that a sufficient overheating suppression effect was achieved in the non-passing regions.

In the roller 53 according to Comparison Example 2, since the fillers (carbon fibers) 53*j* were not collected in the bundle shape similarly as in Comparison Example 1, the hardness at the measuring point "b2" was 47° and the hardness at the measuring point "b1" was 58°, so that the nip width was narrowed to 6 mm. As a result, improper fixing occurred (average density lowering rate: 26%).

Further, the temperature of the film 51 in the non-passing regions was 234° C. and was 9° C. higher than that in Embodiment 2.

(4) Other Embodiments

In the above-described Embodiments 1 and 2, as the binder 53*i*, the epoxy resin (material) was used, but another material taking a binding property to the base material 53*e* into consideration may also be used. Further, the elastic layer 53*b* was molded in the solid rubber but may also be molded in a foam sponge rubber. Further, as the heat-resistant rubber as the base material of the thermally conductive layer 53*c*, the silicone rubber was used, but the foam sponge rubber may also be used.

The fillers 53 collected in the bundle shape may also be dispersed in at least one of the elastic layer 53*b* and the thermally conductive layer 53*c*.

In the fixing device 50 of the film heating type, the heater 54 is not limited to the ceramic heater but may also be a heating element heated by nichrome wire or a heating element made of metal generating heat by electromagnetic induction. Further, the heater 54 is not necessarily positioned in the neighborhood of the nip N but may also be positioned upstream of the nip N with respect to recording material feeding direction.

Use of the roller 53 is not limited to the fixing device 50 of the film heating type but may also be applicable to a fixing device of an electromagnetic induction heating type in which the film 51 itself is constituted as a cylindrical metal film generating heat by the electromagnetic induction.

TABLE 2

| | | EMB. 1 | COMP. EX. 1 | EMB. 2 | COMP. EX. 2 |
|---|---|---|---|---|---|
| CARBON FIBER | KIND | XN-80C-02S | XN-80C-02 | XN-80C-01S | XN-80C-01 |
| | AVERAGE FIBER LENGTH (mm) | 2 | 2 | 1 | 1 |
| | BINDER 53i | EPOXY RESIN | NO BINDER | EPOXY RESIN | NO BINDER |

TABLE 2-continued

| | | EMB. 1 | COMP. EX. 1 | EMB. 2 | COMP. EX. 2 |
|---|---|---|---|---|---|
| THERMALLY CONDUCTIVE LAYER 53c | BASE MATERIAL | ADHESIVE | ADHESIVE | SILICONE RUBBER | SILICONE RUBBER |
| | THICKNESS (mm) | 0.2 | 0.2 | 1 | 1 |
| | CARBON FIBER CONTENT (Vol %) | 15 | 15 | 7 | 7 |
| ASKER-C HARDNESS (°) | ELASTIC LAYER 53b | 32 | 32 | 32 | 32 |
| | THERMALLY CONDUCTIVE LAYER 53c | 39 | 46 | 39 | 47 |
| | PARTING LAYER 53d | 52 | 57 | 52 | 58 |
| EVALUATION RESULT | NIP WIDTH (mm) | 8 | 6 | 8 | 6 |
| | FIXING PROPERTY | ○ | x | ○ | x |
| | NON-PASSING REGION TEMPERATURE RISE | ○ | x | ○ | x |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2018-079662 filed on Apr. 18, 2018 and 2019-029887 filed on Feb. 21, 2019, which are hereby incorporated by reference herein in their entirety.

What is claimed is:

1. A roller for use with an image fixing device for fixing an image on a recording material, said roller comprising:

a core metal; and an elastic layer provided around said core metal, wherein in said elastic layer, a filler bundle including a plurality of fiber-like fillers is dispersed.

2. The roller according to claim 1, wherein said filler bundle is the plurality of fiber-like fillers bonded together with an adhesive.

3. The roller according to claim 2, wherein said adhesive is an epoxy resin material.

4. The roller according to claim 1, wherein said fillers are carbon fibers.

5. The roller according to claim 4, wherein a length of said fillers is 1 mm or more.

6. The roller according to claim 1, wherein a length of said fillers is larger than a thickness of said elastic layer.

7. The roller according to claim 1, wherein said elastic layer is a first elastic layer, wherein said roller further comprises:

a second elastic layer provided between said core metal and said first elastic layer; and a surface layer provided on said first elastic layer, and wherein said first elastic layer is an adhesive layer configured to bond said second elastic layer and said surface layer thereto.

8. The roller according to claim 7, wherein said adhesive layer is a layer of a silicone rubber adhesive.

9. The roller according to claim 1, wherein said filler bundle is a bundle such that a bundle including a single filler and at least two fillers contacting a surface of the single filler constitutes a core and said plurality of fiber-like fillers gather around the core.

10. A fixing device for fixing an image on a recording material, said fixing device comprising:

a rotatable fixing member; and a roller configured to form a fixing nip where the recording material is nipped and fed in cooperation with said rotatable fixing member, wherein said roller is the roller according to claim 1.

11. The fixing device according to claim 10, wherein said rotatable fixing member is a cylindrical film.

12. The fixing device according to claim 11, further comprising a heater contacting an inner surface of said cylindrical film.

* * * * *